United States Patent [19]

Kohmura et al.

[11] 3,937,864

[45] Feb. 10, 1976

[54] HEAT-SENSITIVE RECORDING SHEETS HAVING IMPROVED STABILITY

[75] Inventors: Isao Kohmura; Kiyoshi Futaki, both of Kyoto, Japan

[73] Assignee: Mitsubishi Paper Mills, Ltd., Tokyo, Japan

[22] Filed: Sept. 4, 1973

[21] Appl. No.: 394,012

[30] Foreign Application Priority Data

Sept. 4, 1972 Japan ..... 47-87944

[52] U.S. Cl. ..... 428/411; 427/150; 427/151; 428/488

[51] Int. Cl.[2] ..... B41M 5/00

[58] Field of Search ..... 117/36.2, 36.7, 36.8; 428/411, 488; 427/150, 151

[56] References Cited

UNITED STATES PATENTS

| | | | |
|---|---|---|---|
| 3,244,550 | 4/1966 | Farnham et al. | 117/36.8 X |
| 3,451,338 | 6/1969 | Baum | 117/36.2 X |
| 3,539,375 | 11/1970 | Baum | 117/36.2 |

*Primary Examiner*—Thomas J. Herbert, Jr.
*Attorney, Agent, or Firm*—Sughrue, Rothwell, Mion, Zinn & Macpeak

[57] ABSTRACT

Heat-sensitive recording sheets having an improved stability comprising a colorless or pale-colored chromogenic compound and an organic acid for coloring the chromogenic compound by heating, which are characterized by containing phenol derivatives represented by the formula wherein $R_1$, $R_2$, $R_3$ and $R_4$ are hereinafter defined, is disclosed.

4 Claims, No Drawings

HEAT-SENSITIVE RECORDING SHEETS HAVING IMPROVED STABILITY

BACKGROUND OF THE INVENTION

1. Field of the Invention

The present invention relates to heat-sensitive recording sheets and in more detail to heat-sensitive recording sheets which comprise a heat-sensitive recording element comprising a colorless or pale-colored chromogenic compound and an organic acid which causes coloring of the chromogenic compound by heating wherein a stability of developed images on the heat-sensitive recording element is improved.

2. Description of the Prior Art

Hitherto, it has been known that chromogenic compounds such as Crystal Violet lactone react with phenolic substances to form colors, which is described in *Berichte der Deutschen Chemischen Gesellschaft*, Vol. 42, pages 2934–2935 (1909) by O. Fischer and F. Romer, and that such reaction is applied for the heat-sensitive recording sheets as disclosed in Japanese Pat. No. 14039/70.

Developed images obtained by a thermal reaction of the chromogenic compounds with the organic acids are generally unstable to light and hot wet; for example, developed images of Crystal Violet lactone are very unstable.

Further, in information recording materials, it is remarkably required to preserve recorded images for a long period of time. However, heat-sensitive recording material which satisfies such requirement has not been obtained. Stability used in this specification means that a developed dyestuff does not fade or discolor by exposing to light or by wetting with heat.

It is considered to use a dyestuff having a high light stability in order that recorded images of the heat-sensitive recording material has a stability for a long period of time. However, this is yet insufficient.

SUMMARY OF THE INVENTION

As a result of many studies in order to improve such faults of the heat-sensitive recording sheet, the present inventors have developed heat-sensitive recording sheets having improved stability.

DETAILED DESCRIPTION OF THE INVENTION

The present invention is to provide heat-sensitive recording sheets which comprise an organic acid, a colorless or pale-colored chromogenic compound and phenol derivatives dispersed in a binder, wherein the phenol derivatives are represented by the formula

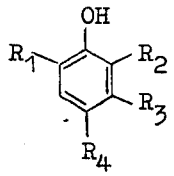

(wherein $R_1$ represents a branched alkyl group having 3 to 8 carbon atoms, $R_2$ represents a hydrogen atom, an alkyl group having 1 to 8 carbon atoms or

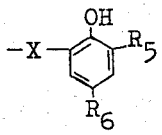

(wherein X represents S, O, $SO_2$, $S_2$ or

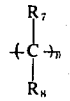

wherein $n$ is an integer of 0 to 3, $R_7$ and $R_8$ represent each a hydrogen atom or an alkyl group having 1 to 8 carbon atoms, or $R_7$ and $R_8$ may form a cyclopentamethylene group by binding together, $R_5$ represents a branched alkyl group having 3 to 8 carbon atoms or

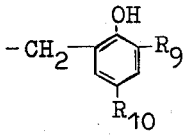

wherein $R_9$ represents a branched alkyl group having 3 to 8 carbon atoms and $R_{10}$ represents an alkyl group having 1 to 8 carbon atoms, and $R_6$ represents an alkyl group having 1 to 8 carbon atoms), $R_3$ represents a hydrogen atom or an alkyl group having 1 to 8 carbon atoms, and $R_4$ represents a hydroxy group, an alkyl group having 1 to 8 carbon atoms, an alkoxy group,

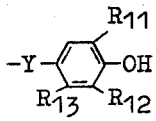

(wherein Y represents S, O, $SO_2$, $S_2$ or

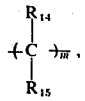

$m$ is an integer of 0 to 3, $R_{14}$ and $R_{15}$ represents each a hydrogen atom or an alkyl group having 1 to 8 carbon atoms or $R_{14}$ and $R_{15}$ may form a cyclopentamethylene group by binding together, $R_{11}$ represents a branched alkyl group having 3 to 8 carbon atoms, and $R_{12}$ and $R_{13}$ represent each a hydrogen atom or an alkyl group having 1 to 8 carbon atoms), or

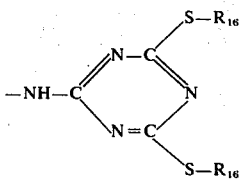

(wherein $R_{16}$ represents an alkyl group having 1 to 18 carbon atoms), or may form a substituted chroman or a substituted coumaran by binding to $R_3$).

Typical phenol derivatives used in the present invention are classified as follows.

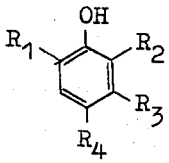

(wherein $R_1$ represents a branched alkyl group having 3 to 8 carbon atoms, $R_2$ and $R_3$ represent each a hydrogen atom or an alkyl group having 1 to 8 carbon atoms, and $R_4$ represents a hydroxyl group, an alkyl group having 1 to 8 carbon atoms or an alkoxy group), (Formula II)

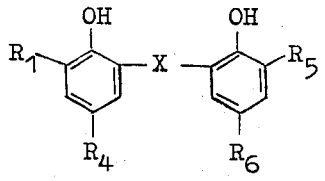

(wherein $R_1$ and $R_5$ represent each a branched alkyl group having 3 to 8 carbon atoms, $R_4$ and $R_6$ represent each an alkyl group having 1 to 8 carbon atoms, and X represents S, O, $SO_2$, $S_2$ or

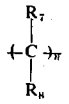

wherein $n$ is an integer of 0 to 3, and $R_7$ and $R_8$ represent each a hydrogen atom or an alkyl group having 1 to 8 carbon atoms or $R_7$ and $R_8$ form a cyclopentamethylene group by binding together), (Formula III)

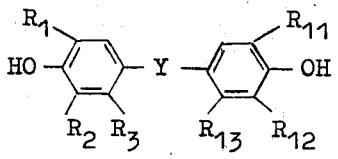

(wherein $R_1$ and $R_{11}$ represent each a branched alkyl group having 3 to 8 carbon atoms, $R_2$, $R_3$, $R_{12}$ and $R_{13}$ represent each a hydrogen atom or an alkyl group having 1 to 8 carbon atoms, and Y represents, S, O, $SO_2$, $S_2$ or

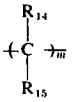

wherein $m$ represents an integer of 0 to 3, and $R_{14}$ and $R_{15}$ each represents a hydrogen atom or an alkyl group having 1 to 8 carbon atoms, or $R_{14}$ and $R_{15}$ form a cyclopentamethylene group by binding together), (Formula IV)

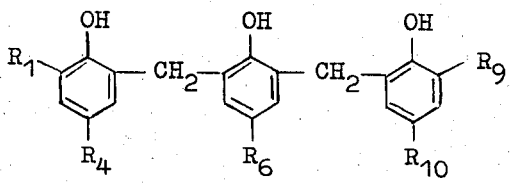

(wherein $R_1$ and $R_9$ represent each a branched alkyl group having 3 to 8 carbon atoms, and $R_4$, $R_6$ and $R_{10}$ represent each an alkyl group having 1 to 8 carbon atoms), (Formula V)

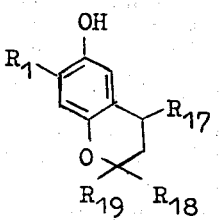

(wherein $R_1$ represents a branched alkyl group having 3 to 8 carbon atoms, $R_{17}$ represents a hydrogen atom or an alkyl group having 1 to 8 carbon atoms, and $R_{18}$ and $R_{19}$ represent each an alkyl group having 1 to 8 carbon atoms), (Formula VI)

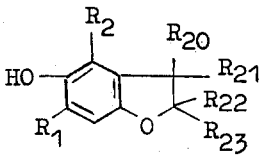

(wherein $R_{20}$, $R_{21}$, $R_{22}$ and $R_{23}$ represents each a hydrogen atom or an alkyl group having 1 to 18 carbon atoms, and $R_1$ represents a branched alkyl group having 3 to 8 carbon atoms), and (Formula VII)

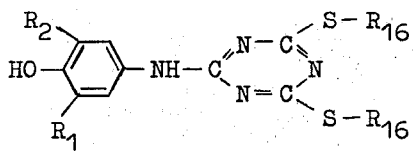

(wherein $R_1$ and $R_2$ represent each a branched alkyl group having 3 to 8 carbon atoms, and $R_{16}$ represents an alkyl group having 1 to 18 carbon atoms).

Typical examples of phenol derivatives used in the present invention are shown below, however, these do not limit the scope of this invention.

Phenol derivatives represented by Formula I (1)

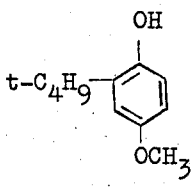

(2)

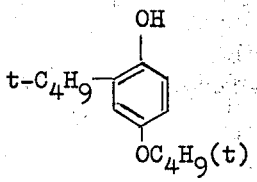

(3)

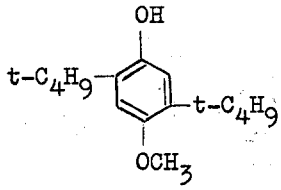

(4)

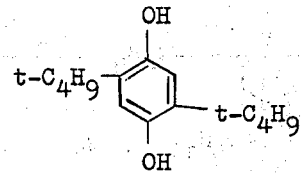

(5)

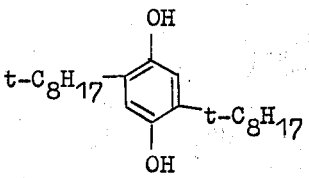

(6)

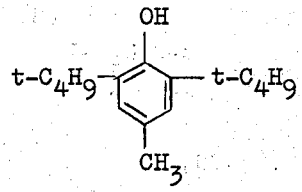

Phenol derivatives represented by Formula II (1)

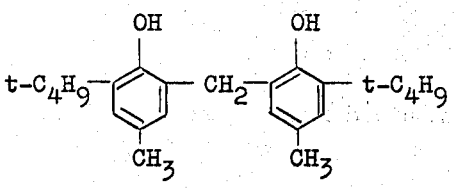

(2)

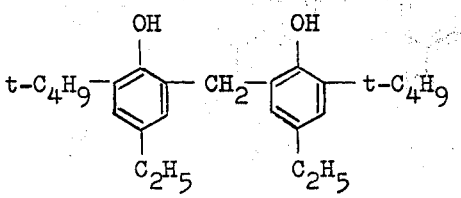

(3)

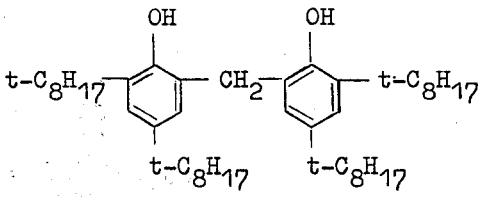

(4)

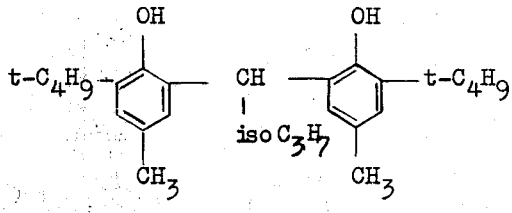

(5)

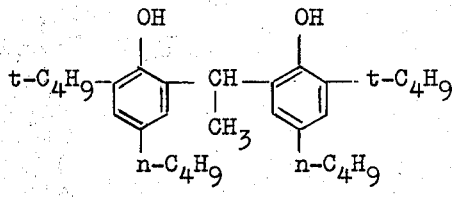

(6)

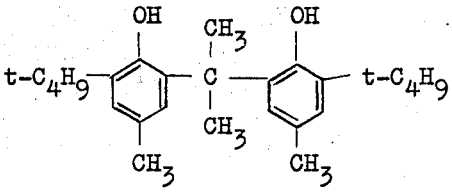

(7)

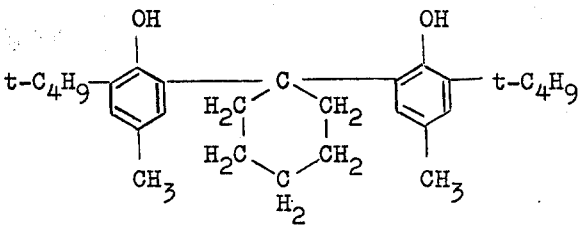

(8)
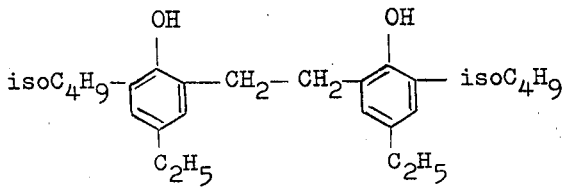
(9)
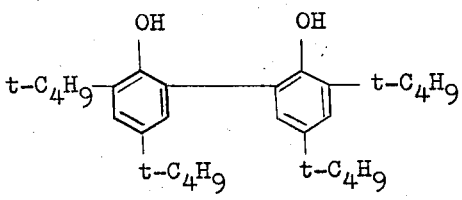
(10)
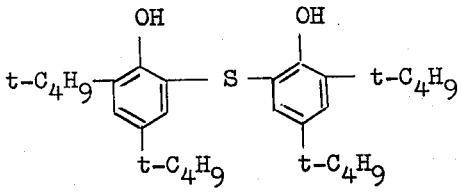
(11)
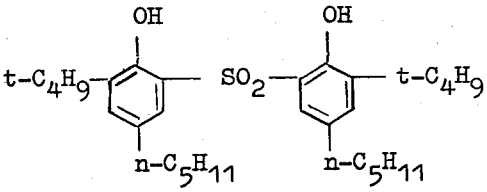
Phenol derivatives represented by Formula III
(1)
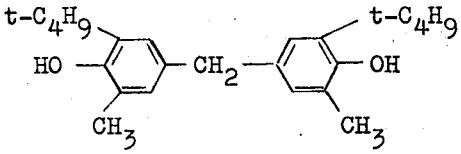
(2)
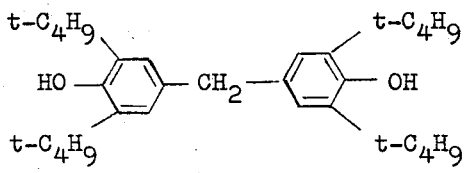
(3)
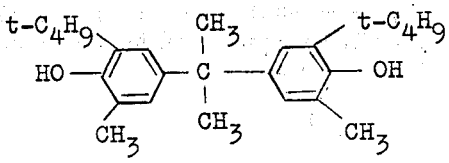
(4)
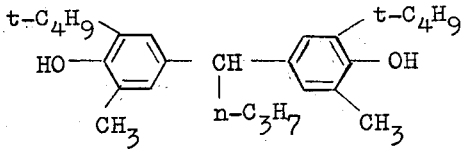
(5)
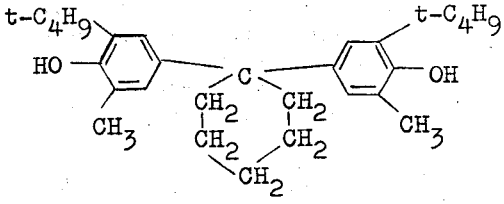
(6)
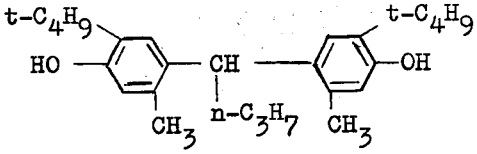
(7)
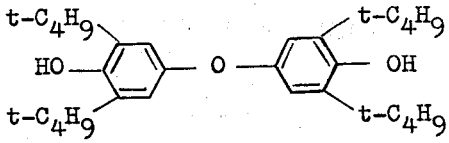
(8)
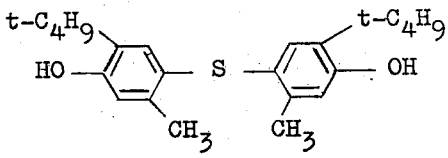
(9)
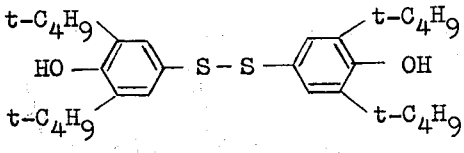
Phenol derivatives represented by Formula IV
(1)
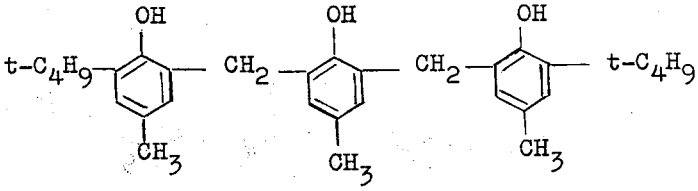

(2)
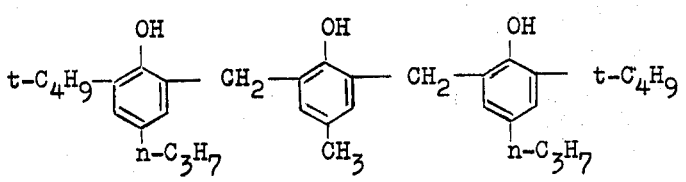
(3)
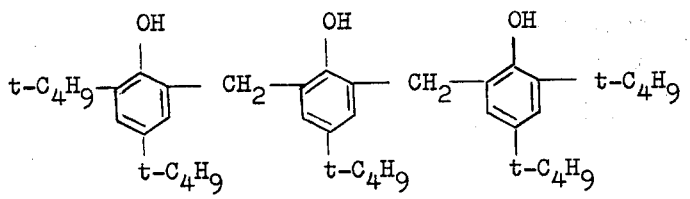
(4)
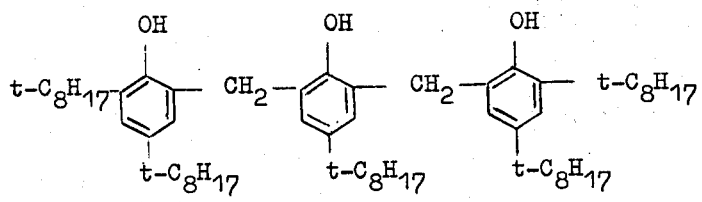
Phenol derivatives represented by Formula V
Derivatives represented by Formula VII
(1)
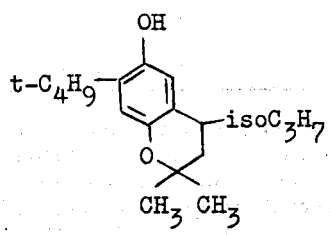
(2)
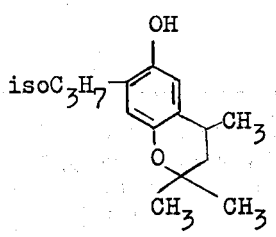
(3)
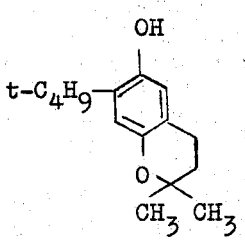
(4)
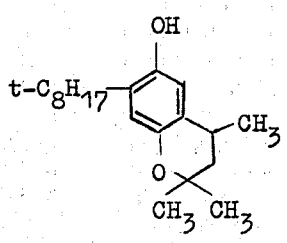
Derivatives represented by Formula VI
(1)
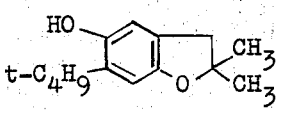
(1)
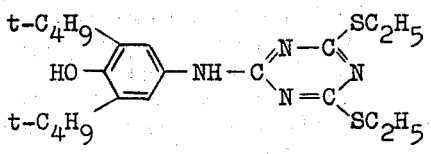

(2)

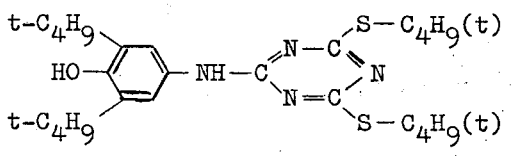

(3)

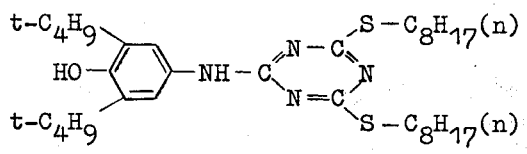

(4)

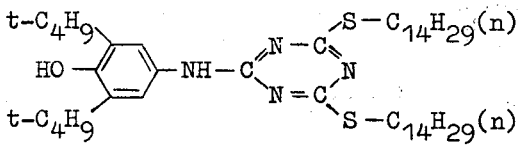

(5)

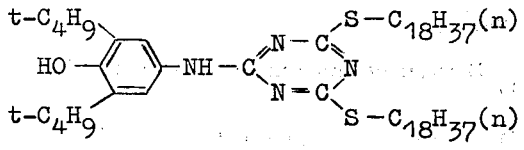

Compounds represented by the above formulae are known as an antioxidant for rubbers, plastics, fibers and petroleum products, and processes for preparing thereof are also known. However, it has not been known that the stability is improved when they are used in heat-sensitive recording elements comprising an organic acid and a chromogenic compound. Further, as the antioxidant for plastics etc., amine type compounds such as diphenylamine, phenothiazine, phenyl-α-naphthylamine and N,N'-diphenyl-p-phenylenediamine, and metal soaps such as cadmium stearate, tin stearate and lead naphthenate have also been known. However, as a result of studies, it has been found that the amine type antioxidants and metal soaps described above hardly exhibit improvement of the stability or cause, sometimes, deterioration of the stability.

On the other hand, by addition of phenol derivatives used in this invention to heat-sensitive recording elements, light fade resistance and hot wet resistance are remarkably improved and the developed images can be preserved for a longer period of time without fading so much. This is a novel fact in the heat-sensitive recording sheet and thus the industrial value thereof is highly evaluated. Among the phenol derivatives represented by the above formulae, those having a too low melting point are not preferred because they cause deterioration of the heat stability. Thus, those having a melting point of above 60°C are preferably used.

The amount of the phenol derivatives used depends upon kinds of the chromogenic compound and the organic acid. However, amounts of 10 to 500% based on the chromogenic compound are preferred.

The colorless or pale-colored chromogenic compounds used in the present invention mean those which color by reacting with organic acids and particularly with polyhydric phenol compounds. Typical examples of such compound are as follows. Crystal Violet lactone, Malachite Green lactone, 3,3-bis-(p-dimethylaminophenyl)-6-aminophthalide, 3,3-bis-(p-dimethylaminophenyl)-6-(p-toluenesulfonamide)-phthalide, 3-diethylamino-7-dibenzylaminofluoran, 3-diethylamino-7-(N-methylanilino)-fluoran, 3-diethylamino-7-(N-methyl-p-toluidino)-fluoran, 3-diethylamino-6-methoxyfluoran, 3-diethylamino-7-chlorofluoran, 3-diethylamino-6-methyl-7-chlorofluoran, 3-dibutylamino-6-methyl-7-chlorofluoran, 3-diethylamino-7-phenylfluoran, 3-morpholino-5,6-benzofluoran, 6'-chloro-8'-methoxy-indolinobenzospiropyran, benzo-β-naphthospiropyran and 3-methyl-di-β-naphthospiropyran.

The organic acids used in the present invention are those which are liquefied and/or vaporized at above room temperature and preferably at above 70°C and have a property that they cause coloring of the colorless or pale-colored chromogenic compound by reacting. Such organic acids include aromatic carboxylic acids such as phthalic anhydride, gallic acid and salicylic acid and phenolic compounds such as 4,4'-isopropylidenediphenol, 4,4'-isopropylidene-bis-(2-chlorophenol), 4,4'-isopropylidene-bis-(2-tertiary-butylphenol), 4,4'-secondarybutylidenediphenol, p,p'-(1-methyl-normalhexylidene)-diphenol, 4-phenylphenol, 4-hydroxydiphenoxide, methyl-4-hydroxybenzoate phenyl-4-hydroxybenzoate, 4-hydroxyacetophenone, salicylanilide, novolak type phenol resins, halogenated novolak type phenol resins, $\alpha$-naphthol and $\beta$-naphthol. Among these compounds, phenol compounds having two or more hydroxyl groups in a molecule give a particularly excellent result.

Further, it is possible to decrease the coloring temperature by using two or more kinds of organic acid together.

In the present invention, it is necessary to use a binder for binding the above described three components, that is, the phenol derivatives, the organic acids and the colorless or pale-colored chromogenic compound which colors by reacting with the organic acids in order to apply a dispersion of these components to a support such as paper, films, etc.

As the binder, water-soluble resins known well are preferably used. Examples of the binder include polyvinyl alcohol, methylcellulose, hydroxyethylcellulose, gum arabic, carboxymethylcellulose, starch, gelatin, casein, polyvinylpyrrolidone, styrene-maleic anhydride copolymers, polyacrylates and polyacrylic acid copolymers. However, in the case that the support is thin paper, it is difficult to apply an aqueous solution of such water-soluble resins because creases are caused by great expansion and contractions of the paper at application. In such case, it may be used non-aqueous solutions of solvent-soluble resins such as terpene resin, petroleum resins and cyclized rubbers as the binder.

As shown above, in the present invention, the organic acid, the colorless or pale-colored chromogenic compound and the phenol derivatives having the above described formulae are dispersed in the binder. In this case, it is preferred that dispersion particles are ground by a grinder such as a ball mill as fine as possible, such as having below several microns of particle size.

In addition, as the grinding assistant, active agents such as a dispersing agent and a defoaming agent may be added, if necessary. Further, it is possible to add a bleaching agent or to add fillers such as talc, clay and starch in order to prevent adhesion of the coating material to a thermal head at thermal printer. Furthermore, it is possible to add waxes to the dispersion in order to prevent coloring by pressure, that is, staining of the background by scratching, rubbing or pressing.

In the following, typical examples of the invention are described in order to explain in more detail.

EXAMPLE 1

| | | |
|---|---|---|
| Liquid A: | | |
| | Crystal Violet lactone | 1 g |
| | 5% aqueous solution of hydroxyethylcellulose (Commercial name: HEC BL-15, produced by Fuji Chemical K.K.) | 5 g |
| | Water | 4.4 g |
| Liquid B: | | |
| | 4,4'-Isopropylidenediphenol | 5 g |
| | 5% Aqueous solution of hydroxyethylcellulose | 25 g |
| | Water | 22 g |
| Liquid C: | | |
| | 4,4'-Thiobis-(6-tertiary-butyl-3-methylphenol) (Compound III-8) | 1 g |
| | 5% Aqueous solution of hydroxyethylcellulose | 5 g |
| | Water | 4.4 g |

The above liquids A, B and C were dispersed respectively by a ball mill for 2 days. Then these liquids A, B and C were mixed to produce a heat-sensitive coating liquid. This coating liquid was applied to a paper having 50 g/m$^2$ of the weight so as to have 3 g/m$^2$ after drying to produce a heat-sensitive recording sheet. Similarly, another heat-sensitive recording sheets were obtained with using compounds shown in Table 1 instead of 4,4'-thiobis-(6-tertiary-butyl-3-methylphenol). Properties of the resulting heat-sensitive recording sheets are shown in Table 1.

As being clear from this table, the heat-sensitive recording sheets using phenol derivatives of the present invention form developed dyestuffs having a very high stability and the images do not disappear if preserved for a long period of time.

TABLE 1

| Compound | *Residual color ratio after exposing to light by a fluorescent lamp for 24 hours (%) | **Residual color ratio after exposing to sunlight for 1 week (%) |
|---|---|---|
| None | 52 | 16 |
| 4,4'-thio-bis-(6-t-butyl-3-methylphenol) III-(3) | 90 | 76 |
| 2-tertiary-butyl-4-tertiary-butoxyphenol I-(2) | 75 | 62 |
| 2,2'-methylene-bis-(4-methyl-6-t-butylphenol) II-(1) | 63 | 50 |
| 4,4'-methylene-bis-(2,6-di-tertiary-butylphenol) III-(2) | 76 | 62 |
| 2,2-dimethyl-4-isopropyl-7-tertiary-butyl-6-chromanol V-(1) | 83 | 70 |
| 2,2-dimethyl-6-tertiary-butyl-5-benzofuranol | 78 | 68 |
| 4-(4,6-bis-(tertiary-butyl-thio)-s-triazin-2-yl)amino-2,6-ditertiary-butylphenol VII-(2) | 88 | 80 |

TABLE 1-continued

| Compound | *Residual color ratio after exposing to light by a fluorescent lamp for 24 hours (%) | **Residual color ratio after exposing to sunlight for 1 week (%) |
|---|---|---|
| Phenyl-α-naphthylamine | 51 | 18 |
| Cadmium stearate | 28 | 15 |
| Zinc diethyldithiocarbamate | 22 | 10 |
| Mercaptobenzothiazole | 20 | 10 |

| Compound | ***Residual color ratio after the lapse of 1 week at 50°C and 80% (%) | Note |
|---|---|---|
| None | 60 | Comparison |
| 4,4'-thio-bis-(6-t-butyl-3-methylphenol) III-(3) | 95 | This invention |
| 2-tertiary-butyl-4-tertiary-butoxyphenol I-(2) | 82 | " |
| 2,2'-methylene-bis-(4-methyl-6-t-butylphenol) II-(1) | 76 | " |
| 4,4'-methylene-bis-(2,6-di-tertiary-butylphenol) III-(2) | 84 | " |
| 2,2-dimethyl-4-isopropyl-7-tertiary-butyl-6-chromanol V-(1) | 92 | " |
| 2,2-dimethyl-6-tertiary-butyl-5-benzofuranol | 88 | " |
| 4-(4,6-bis-(tertiary-butyl-thio)-s-triazin-2-yl)amino-2,6-ditertiary-butylphenol VII-(2) | 95 | " |
| Phenyl-α-naphthylamine | 58 | Comparison |
| Cadmiun stearate | 61 | " |
| Zinc diethyldithiocarbamate | 55 | " |
| Mercaptobenzothiazole | 51 | " |

(Note)
*Residual color ratio are represented by the formula $$\frac{\text{Color density after testing}}{\text{Color density before testing}} \times 100$$

at 1.1 ~ 1.2 of the developed color density.
**The developed color density is determined by a Macbeth densitometer.
***A day-light fluorescent lamp is used as the fluorescent lamp.

EXAMPLE 2

A heat-sensitive recording sheet was produced by the same manner as in Example 1 but used 3-diethylamino-7-chlorofluoran instead of Crystal Violet lactone and 4,4'-methylene-bis-(2,6-di-tertiary-butylphenol) (Compound III - (2)) instead of 4,4'-thiobis-(6-tertiary-butyl-3-methylphenol). When exposed to light by a fluorescent lamp for 24 hours, a residual color ratio of the sheet in which 4,4'-methylene-bis-(2,6-di-tertiary-butyl phenol) is used is 88% while that of the sheet in which 4,4'-methylene-bis-(2,6-di-tertiary-butylphenol) is not used is 43%, which shows that the stability is improved.

EXAMPLE 3

| | |
|---|---|
| Liquid A: | |
| 3-Diethylamino-7-dibenzylaminofluoran | 1 g |
| 10% aqueous solution of polyvinyl alcohol (commercial name: Gosenol NH-20, produced by Nippon Gosei Kagaku K.K.) | 2 g |
| Water | 3 g |
| Liquid B: | |
| 1,1-Bis-(4-hydroxyphenyl)cyclohexane | 5 g |
| 10% aqueous solution of polyvinyl alcohol | 10 g |
| Water | 15 g |
| Liquid C: | |
| α, α'-Bis-(5-tert-butyl-6-hydroxy-m-tolyl)mesitol (Compound IV - (1)) | 1.5 g |
| 10% aqueous solution of polyvinyl alcohol | 3 g |
| Water | 4.5 g |

The above described liquids A, B and C were treated by the same manner as in Example 1. These three liquids were mixed. Then 20 g of a 50% dispersion of wheat starch, 5 g of a 20% wax emulsion (commercial name: Repol No. 50, produced by Daikyo Kagaku K.K.) and 20 g of a 10% aqueous solution of polyvinyl alcohol were added to the mixture to produce a heat-sensitive coating liquid. This coating liquid was applied to a paper having 50 g/m² of the weight so as to have 5 g/m² after drying to produce a heat-sensitive recording sheet. This heat-sensitive recording sheet had an excellent storage stability for a long period of time.

While the invention has been described in detail and with reference to specific embodiments thereof, it will be apparent to one skilled in the art that various changes and modifications can be made therein without departing from the spirit and scope thereof.

What is claimed is:

1. Heat-sensitive recording sheets having an improved stability comprising a colorless or pale-colored chromogenic compound and an organic acid for coloring said chromogenic compound by heating, which contain at least one phenol derivative different from said chromogenic compound and said organic acid, which phenol derivative is present in an amount of 10 to 500 wt % based on the weight of chromogenic compound and increases the stability of the colored reaction product of the chromogenic compound and is selected from the group consisting of (Formula I)

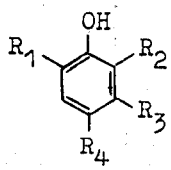

(wherein $R_1$ represents a branched alkyl group having 3 to 8 carbon atoms, $R_2$ and $R_3$ represent each a hydrogen atom or an alkyl group having 1 to 8 carbon atoms, and $R_4$ represents a hydroxyl group, an alkyl group having 1 to 8 carbon atoms or an alkoxy group), (Formula II)

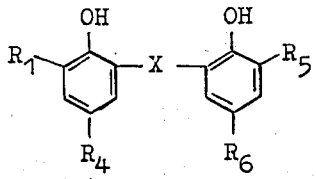

(wherein $R_1$ and $R_5$ represent each a branched alkyl group having 3 to 8 carbon atoms, $R_4$ and $R_6$ represent each an alkyl group having 1 to 8 carbon atoms, and X represents S, O, $SO_2$, $S_2$ or

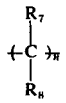

wherein $n$ is an integer of 0 to 3, and $R_7$ and $R_8$ represent each a hydrogen atom or an alkyl group having 1 to 8 carbon atoms or $R_7$ and $R_8$ form a cyclopentamethylene group by binding together)

(Formula III)

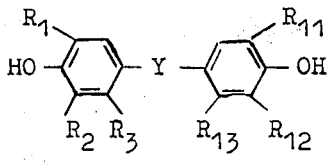

(wherein $R_1$ and $R_{11}$ represent each a branched alkyl group having 3 to 8 carbon atoms, $R_2$, $R_3$, $R_{12}$ and $R_{13}$ represent each a hydrogen atom or an alkyl group having 1 to 8 carbon atoms, and Y represents S, O, $SO_2$, $S_2$ or

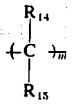

wherein $m$ represents an integer of 0 to 3, and $R_{14}$ and $R_{15}$ each represents a hydrogen atom or an alkyl group having 1 to 8 carbon atoms, or $R_{14}$ and $R_{15}$ form a cyclopentamethylene group by binding together), (Formula IV)

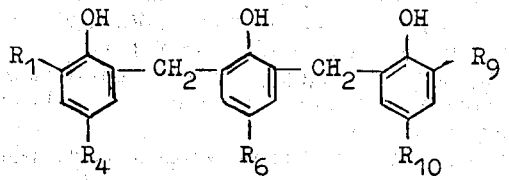

(wherein $R_1$ and $R_9$ represent each a branched alkyl group having 3 to 8 carbon atoms, and $R_4$, $R_6$ and $R_{10}$ represent each an alkyl group having 1 to 8 carbon atoms), (Formula V)

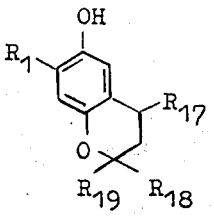

(wherein $R_1$ represents a branched alkyl group having 3 to 8 carbon atoms, $R_{17}$ represents a hydrogen atom or an alkyl group having 1 to 8 carbon atoms, and $R_{18}$ and $R_{19}$ represent each an alkyl group having 1 to 8 carbon atoms), (Formula VI)

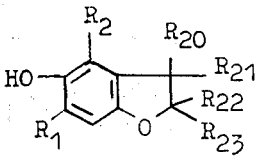

(wherein $R_{20}$, $R_{21}$, $R_{22}$ and $R_{23}$ represent each a hydrogen atom or an alkyl group having 1 to 18 carbon atoms, and $R_1$ represents a branched alkyl group having 3 to 8 carbon atoms, $R_2$ represents a hydrogen atom or an alkyl group having 1 to 8 carbon atoms), and (Formula VII)

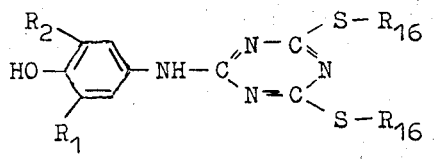

(wherein $R_1$ and $R_2$ represent each a branched alkyl group having 3 to 8 carbon atoms, and $R_{16}$ represents an alkyl group having 1 to 18 carbon atoms).

2. Heat-sensitive recording sheets as claimed in claim 1, wherein said at least one phenol derivative has a melting point of above 60°C.

3. Heat-sensitive recording sheets as claimed in claim 1, wherein said chromogenic compound is at least one leuco dye having a lactone or spiropyran ring.

4. Heat-sensitive recording sheets as claimed in claim 1, wherein said at least one phenol derivative is selected from the group consisting of:

Phenol derivatives represented by Formula I (1)

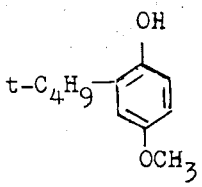

(2)

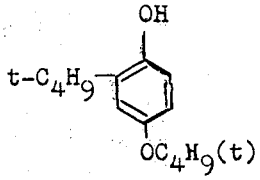

(3)

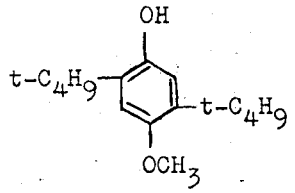

(4)

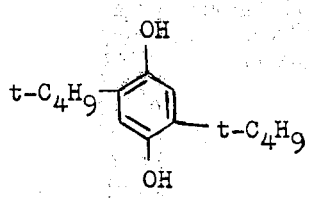

(5)

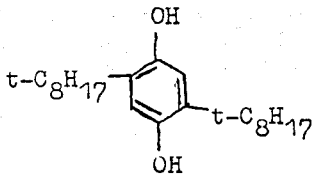

(6)

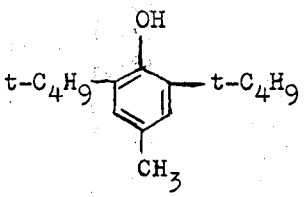

Phenol derivatives represented by Formula II (1)

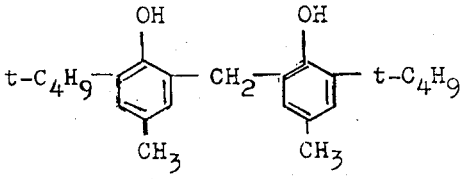

(2)

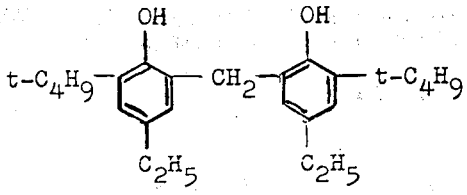

(3)

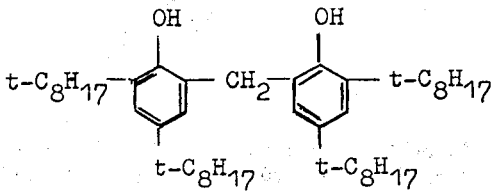

(4)

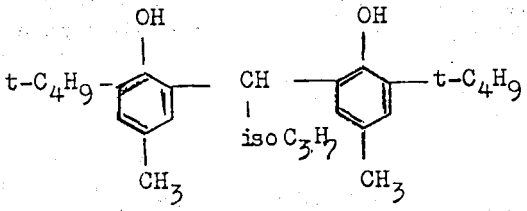

(5)

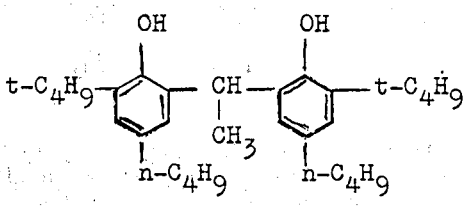

(6)

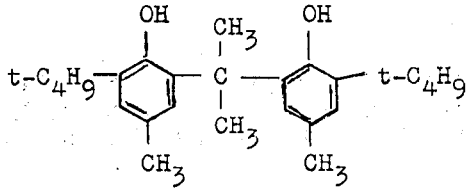

(7)
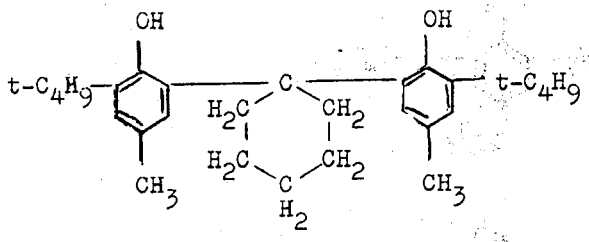
(8)
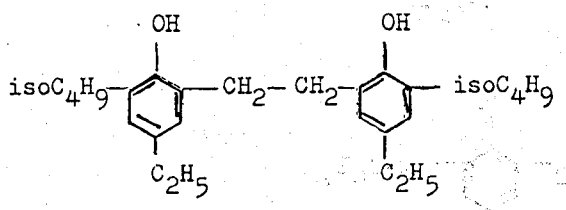
(9)
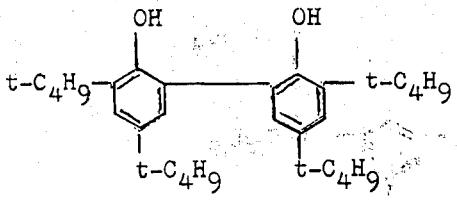
(10)
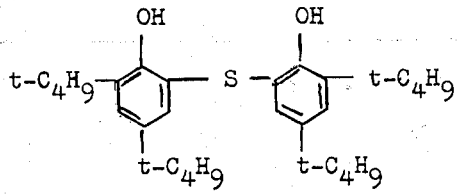
and
(11)
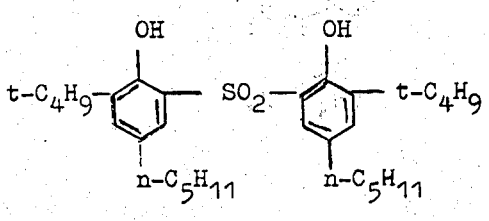
Phenol derivatives represented by Formula III
(1)
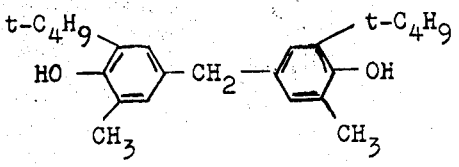
(2)
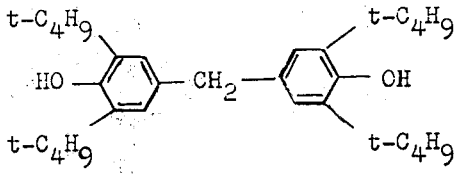
(3)
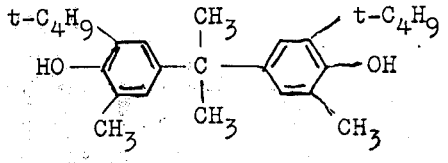
(4)
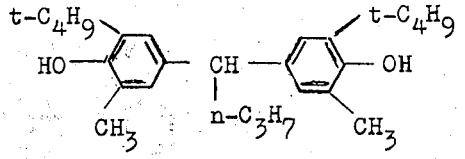
(5)
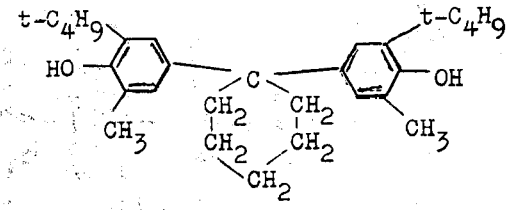
(6)
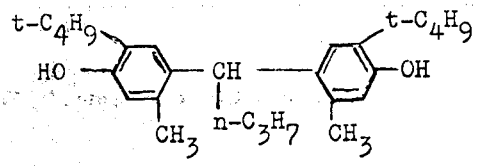
(7)
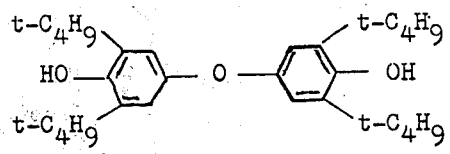
(8)
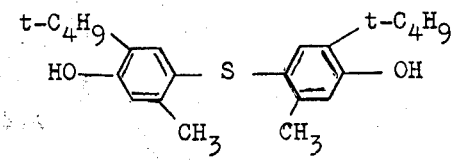
(9)
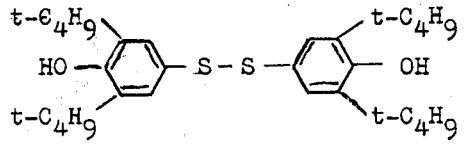
Phenol derivatives represented by Formula IV (1)
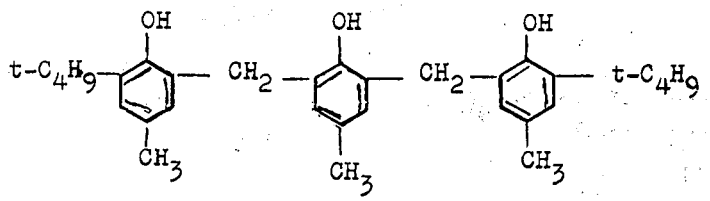
(2)
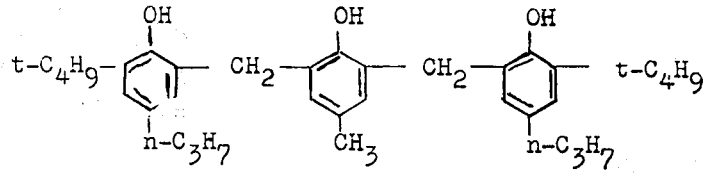
(3)
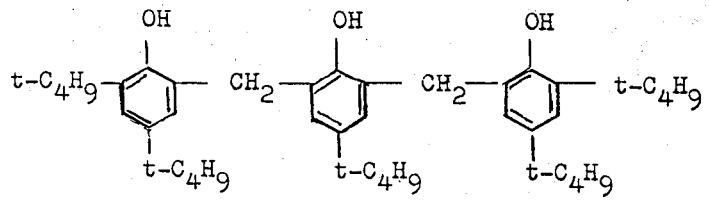
(4)
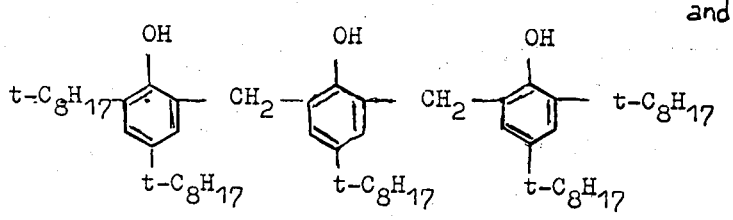
and
Phenol derivatives represented by Formula V
(1)
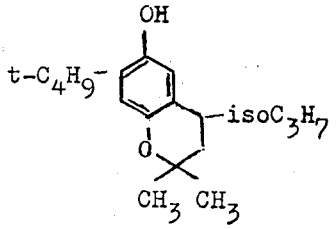
(2)
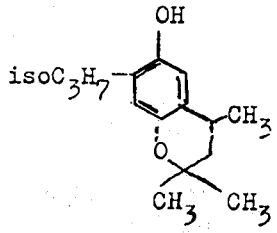
(3)
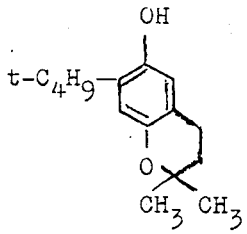
and
(4)
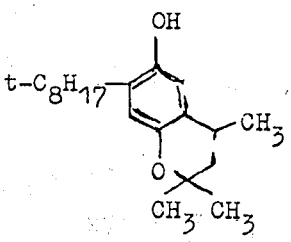

Derivatives represented by Formula VI
(1)
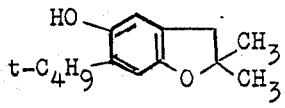
, and
Derivatives represented by Formula VII
(1)
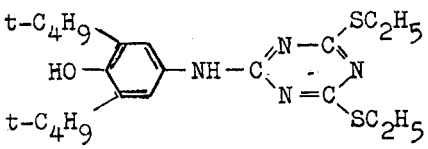
(2)
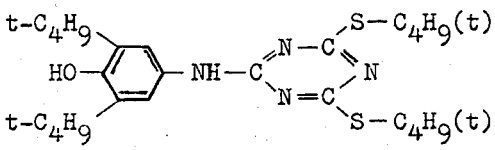
(3)
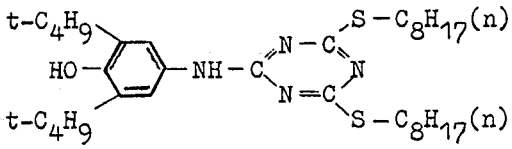
(4)
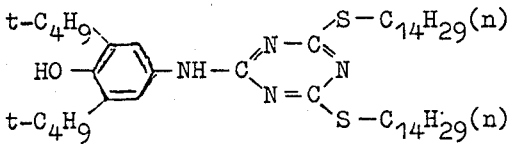
and
(5)
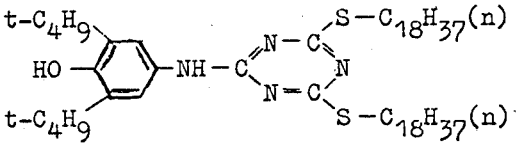
* * * * *